US009599297B2

(12) United States Patent
Stephens

(10) Patent No.: US 9,599,297 B2
(45) Date of Patent: Mar. 21, 2017

(54) VISUAL MEDIA SOFT LIGHT SYSTEM

(71) Applicant: Fill-Lite, LLC, Beaverton, OR (US)

(72) Inventor: Owen B. Stephens, Beaverton, OR (US)

(73) Assignee: FILL-LITE, LLC, Beaverton, OR (US)

( * ) Notice: Subject to any disclaimer, the term of this patent is extended or adjusted under 35 U.S.C. 154(b) by 67 days.

(21) Appl. No.: 14/152,588

(22) Filed: Jan. 10, 2014

(65) Prior Publication Data

US 2014/0198527 A1 Jul. 17, 2014

Related U.S. Application Data

(60) Provisional application No. 61/751,517, filed on Jan. 11, 2013.

(51) Int. Cl.

| | |
|---|---|
| ***F21S 8/04*** | (2006.01) |
| ***F21S 8/08*** | (2006.01) |
| ***F21V 21/30*** | (2006.01) |
| ***H05B 33/08*** | (2006.01) |
| *F21V 23/04* | (2006.01) |
| *F21Y 105/00* | (2016.01) |
| *F21Y 113/00* | (2016.01) |
| *F21Y 101/00* | (2016.01) |

(52) U.S. Cl.

CPC ..... *F21S 8/08* (2013.01); *F21V 21/30* (2013.01); *H05B 33/0803* (2013.01); *H05B 33/086* (2013.01); *F21V 23/04* (2013.01); *F21V 2200/20* (2015.01); *F21Y 2101/00* (2013.01); *F21Y 2105/00* (2013.01); *F21Y 2113/00* (2013.01)

(58) Field of Classification Search

CPC ..... H05B 33/0857; F21S 10/02; F21S 2/005; F21V 21/005; G02B 6/0078; G02F 1/133615

See application file for complete search history.

(56) References Cited

U.S. PATENT DOCUMENTS

| | | | | |
|---|---|---|---|---|
| 8,096,671 | B1 | 1/2012 | Cronk | |
| 2002/0048169 | A1 | 4/2002 | Dowling | |
| 2003/0214718 | A1* | 11/2003 | Kaminsky | G02B 5/0221 359/599 |
| 2006/0237636 | A1 | 10/2006 | Lyons et al. | |

(Continued)

OTHER PUBLICATIONS

PCT International Search Report and Written Opinion dated May 6, 2014 issued from the US Patent Office for PCT/US14/11093 (11 Pages).

(Continued)

*Primary Examiner* — Andrew Coughlin

(74) *Attorney, Agent, or Firm* — Schwabe, Williamson & Wyatt

(57) ABSTRACT

Improved soft lighting systems for the arts, media, and entertainment industry are disclosed. In certain aspects, the systems employ one or more edge-lit LED light guide panels using high flux, optical grade, and/or binned LEDs to produce higher quality, uniform, diffused soft visual media light. In further preferred aspects the systems are modular and portable, and have light guide panels that may be axially tilted in horizontal and vertical directions to independently direct the soft light emanating from each of the panels to achieve the desired soft lighting set up.

20 Claims, 12 Drawing Sheets

(56) References Cited

U.S. PATENT DOCUMENTS

| | | | | |
|---|---|---|---|---|
| 2008/0055931 | A1* | 3/2008 | Verstraete | G02B 6/0068 362/612 |
| 2010/0237804 | A1 | 9/2010 | Liang | |
| 2010/0301768 | A1 | 12/2010 | Chemel | |
| 2012/0044374 | A1 | 2/2012 | Pohlert et al. | |
| 2012/0113679 | A1 | 5/2012 | Boonekamp | |
| 2013/0208443 | A1* | 8/2013 | Pearsall | F21V 9/16 362/84 |

OTHER PUBLICATIONS

Larosa, Kelly; "Spotlight: Cineo TruColors LS & HS"; ARC Blog; http://blog.adoramarentals.com/spotlight-cineo-trucolors-ls-hs; Oct. 14, 2013; 3 Pages; retrieved from Internet Jan. 9, 2014.

Cineo Lighting; "Remote Phosphor Technology A New Concept in Image Capture Lighting" v03-19-13; copyright 2013; www.cineolighting.com; 1 page.

Cineo Lighting; "TruColor/HS"; v03-19-13; copyright 2013; www.cineolighting.com; 2 pages.

Cineo Lighting; "Press Release—Cineo Lighting Introduces Trucolor LS"; Mountain View CA; Apr. 5, 2013; http://cineolighting.com/index/php/pages/news; 1 Page; retrieved from internet Jan. 9, 2014.

Cineo Lighting: "Press Release—PRG Launches Award-Winning Digital Light Fixture Trucolor HS"; Armonk, NY; Apr. 12, 2012; http://cineolighting.technicate.com/index.php/pages/news/119; 1 Page; retrieved from Internet Jan. 9, 2014.

Cineo Lighting; "TruColor/XS"; v09-09-13; copyright 2013; www.cineolighting.com; 2 pages.

Rosco Laboratories US; LitePad AXIOM, product description; copyright 1998-2014; http://www.rosco.com/litepad/litepadAxiom.cfm; 2 Pages; retrieved from internet Jan. 9, 2014.

Rosco Laboratories US; LitePad DL, product description; copyright 1998-2014; http://www.rosco.com/litepad/litepadDL.cfm; 2 Pages; retrieved from Internet Jan. 9, 2014.

Rosco Laboratories US; LitePad HO+, product description; copyright 1998-2014; http://www.rosco.com/litepad/litepadHO.cfm; 3 Pages; retrieved from Internet Jan. 9, 2014.

Cree, Inc; "LED Color Mixing: Basics and Background", Technical Article; Copyright 2010-2013; www.cree.com/led-components-and-modules/tools-and-support/tools; 24 Pages.

* cited by examiner

VISUAL MEDIA SOFT LIGHT SYSTEM

RELATED APPLICATIONS

This application claims the benefit of the filing of U.S. provisional patent application No. 61/751,517, filed Jan. 11, 2013.

BACKGROUND

The present invention relates generally to visual media soft lighting systems such as visual media display illumination and studio and location illumination for television, video, theatrical, film, and photographic production.

In visual media illumination or lighting, soft light refers to diffused light that tends to "wrap" around objects, casting virtually no visible shadows or diffused shadows with soft edges. Visual media lighting can emphasize important details or obscure them. It can flatter a subject by bringing out positive attributes and it can de-emphasize or hide less attractive attributes. The use of soft light is especially popular in cinematography and film-making to cast "shadowless light" that reduces shadows without creating additional shadows, to make a subject appear more beautiful or youthful by making age lines and wrinkles less visible, and by supplementing the lighting from other sources. This technique is also used to perform motivated lighting in which light in the scene appears to come from actual light sources depicted in the scene. Soft light does not cast shadows that would be a giveaway of a supplementary light source.

Prior to the 1980's, studio and location filming used different methods to create a natural, shadowless soft light effect, which is sometimes called base light or fill light. The goal of soft lighting has been to bring a base light, or ambient light, to a dark space. Accent lighting was then added with key lights or back lights in accordance with standard three point lighting techniques. By using three point lighting, the filmed subject may be illuminated however desired while also controlling or eliminating the shading and shadows produced by direct lighting. The difference between the key light and the fill light in three point lighting is that key light is generally directional light and fill light is generally diffused light. The key light is meant to define the object/person, whereas the fill light is used to soften the shadows and even-out the contrast. In three point lighting the back light separates the object from the background, giving depth to the scene.

Light passing through a diffuser is softer and purposely less-defined and less-directional. A good example of natural diffused light is when the sun shines through fog. The light appears to come from all directions, whereas without the fog one would see distinct shadows produced by undiffused, direct sunlight. To achieve soft (i.e., diffused) base light artificially, large, bright incandescent lights are sometimes set up to shine through large translucent silks or to be reflected off shiny or flat, white boards. These methods, however, are clumsy to set up and control. In addition, they use a large footprint, require much manpower, time, and supporting equipment. Hot incandescent lights use significant amounts of power, and air-conditioning is often required to cool stages. Beginning in the 1980's, fluorescent lights were sometimes used, cutting power requirements, heat, footprint and weight. Currently, various combinations of such equipment are used.

Another aspect of visual media soft lighting is the color temperature of the light source. One consideration for professional cinematographers, using film, is how the color temperature of the illumination interacts with the film emulsion. (Video recording has white balance control and so is less sensitive to color temperature issues.) The Kelvin temperature scale (K) is the numerical measurement that is used to describe the color appearance of light produced by a light source (e.g., a lamp) and also the color appearance of the light source itself.

Color temperature values are based upon a theoretical black body radiator, such as a block of black metal through which electric current is passed. Black body radiation has a characteristic, continuous frequency spectrum that depends only on the body's temperature, referred to as Planck spectrum or Planck's law. The spectrum is peaked at a characteristic frequency that shifts to higher frequencies with increasing temperature. As the block of black metal is heated, it turns red-yellow, then white, then blue. As the temperature of the metal is measured at any given color produced, the color is matched to that temperature and a color temperature value is determined. For example, a Kelvin temperature of 5000K produces roughly neutral light, whereas 3000K and 9000K produce light spectrums which shift from neutral to contain more orange and blue wavelengths, respectively.

The Kelvin temperature of light sources is thus used to categorize them as warm, neutral or cool sources. These terms are not directly related to temperature; instead, they describe how the light source appears visually. Warm sources actually have a lower color temperature (3500K or less), producing a red-yellow appearance associated with conventional tungsten filament incandescent bulbs (often referred to as "tungsten lighting"). Neutral sources (between 3500K and 4100K) tend to have a more yellow appearance. The following table is a rule of thumb guide to the correlated temperature of some common light sources:

| Color Temperature | Light Source |
|---|---|
| 1000-2000 K | Candlelight |
| 2500-3500 K | Tungsten Bulb (household variety) |
| 3000-4000 K | Sunrise/Sunset (clear sky) |
| 4000-5000 K | Fluorescent Lamps |
| 5000-5500 K | Electronic Flash |
| 5000-6500 K | Daylight with Clear Sky (sun overhead) |
| 6500-8000 K | Moderately Overcast Sky |
| 9000-10000 K | Shade or Heavily Overcast Sky |

A lamp with a color temperature of 5000K is considered pure white (full spectrum) light, with the lamp becoming more blue in color as the color temperature is increased. Warm light sources are traditionally used for applications where warm colors or earth tones dominate the environment, such as when there is a need to impart a feeling of comfort, coziness and relaxation. Cool light sources (5000K+) with high color rendering capabilities, such as full spectrum lights, are traditionally used for applications where there is a need to enhance all colors equally. Soft lighting for video is typically flat (no shadows) and has a high color temperature (approx. 5600 Kelvin). In contrast, typical stage soft lighting is more dimensional, casting shape-defining shadows, and lower in color temperature (approx. 3200 Kelvin). Soft lighting for cinematographic film purposes may use both types.

Currently, some visual media lighting employs LED lighting technology such as an array of front-facing LEDs distributed across a rear panel and directly illuminating a translucent diffuser. An LED luminaire generally consumes less power and generates less heat than corresponding incandescent and fluorescent soft lighting products and can typically cast light at greater effective distances. Moreover, typical life span ratings for an LED lamp can be as much as 100,000 hours. As a result of these advantages, LED luminaires have recently begun to be used in certain stage, studio and location lighting applications. However, these LED luminaires do not achieve color temperature and color rendering characteristics of conventional incandescent lights. Further, previous such LED luminaires have not been designed to work well in a range of different physical space requirements and changing set conditions with a minimum of set up time. Accordingly, although luminaires using LED technology have found some limited use in the arts, media, and entertainment soft lighting industry, there still exists a need for improvement in the light quality and efficiency in order to satisfy the lighting performance expectations of visual media lighting professionals.

Accordingly there presently exists a need to improve the quality, performance, portability, and footprint requirements of existing lighting equipment used to provide soft visual media light in stage, studio, and other visual media lighting applications. It would be a further advantage to provide soft lighting equipment that is reconfigurable and able to accommodate a range of different physical space requirements including relatively tight spaces, which is portable and which also is adaptable to changing set conditions with a minimum of set-up time. The various aspects of the systems of the subject invention as disclosed herein are particularly suited for meeting these and other constraints in this field.

SUMMARY OF THE INVENTION

The present invention includes various alternate embodiments of novel and unique visual media soft light systems for the arts, media, and entertainment industries. In one implementation, the system employs one or more LED light source edge-lit light guide panels that may employ high flux, optical grade, and/or binned LEDs to produce higher-quality, uniform, soft lighting. As another aspect the system can be modular and portable for use in tight, restricted spaces and can be easily set up and reconfigured to direct the lighting for the visual effects desired. The light guide panels can be mounted on modular wall type frames or individual yokes permitting independent dual axial movements allowing easy tilting and panning of individual panels without physically moving the lighting fixtures. In other alternative aspects, remote phosphor LEDs, remote control lighting controls, and frame mounted control and power circuitry provide yet further advantages.

Further forms, objects, features, aspects, benefits, advantages, and embodiments of the present disclosure will become apparent from a detailed description and drawings provided herewith.

DETAILED DESCRIPTION

Figure 1:
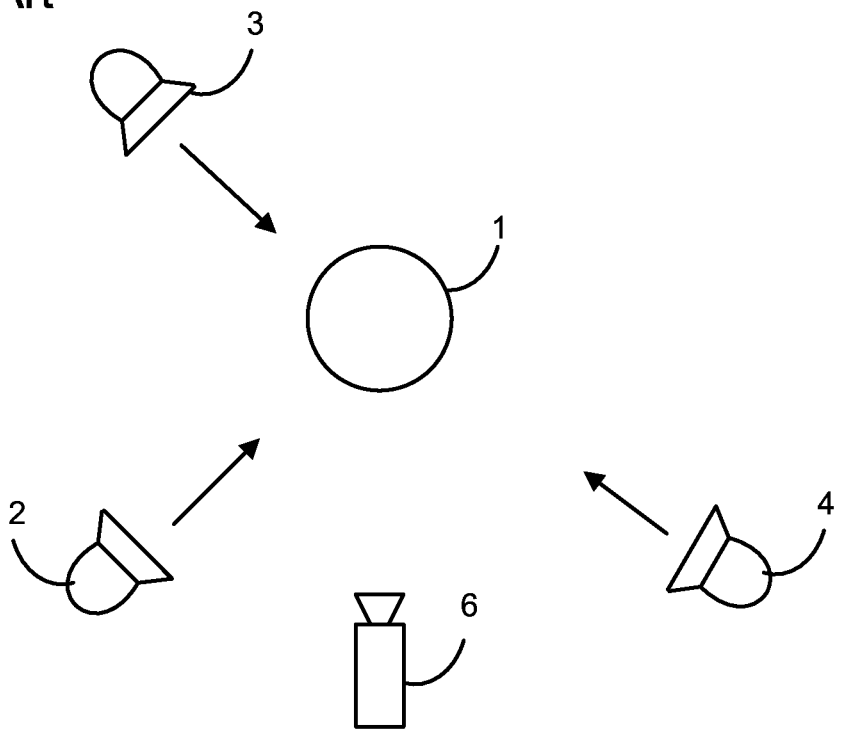
Fig. 1 Prior Art
FIG. 1 is a schematic depiction of a standard prior art three point lighting set up.

For the purposes of promoting an understanding of the principles of the invention, reference will now be made to the examples, sometimes referred to as embodiments, illustrated and/or described herein. These are intended merely as examples. It will nevertheless be understood that no limitation of the scope of the invention is thereby intended. Such alterations and further modifications in the described processes, systems or devices, any further applications of the principles of the invention as described herein, are contemplated as would normally occur to one skilled in the art to which the invention relates, now and/or in the future in light of this document.

As used in the claims and the specification, the following terms have the following definitions:

"soft light", as herein used, should be understood to refer to diffused light that does not cast a defined shadow.

"LED" should be understood to include any light-emitting diode, electroluminescent diode, or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like. In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured to generate radiation having various bandwidths for a given spectrum (e.g., narrow bandwidth, broad bandwidth).

"illuminate" should be understood to refer to the production of one or more frequencies of radiation by an illumination source.

"color" should be understood to refer to any frequency or combination of frequencies of radiation within a spectrum, and may include frequencies not only of the visible spectrum, but also frequencies in the infrared and ultraviolet areas of the spectrum, and in other areas of the electromagnetic spectrum.

"light source" should be understood to refer to any one or more of a variety of radiation sources, including, but not limited to, LED-based sources as defined above, incandescent sources (e.g., filament lamps, halogen lamps), fluorescent sources, phosphorescent sources, high-intensity discharge sources (e.g., sodium vapor, mercury vapor, and metal halide lamps), lasers, other types of luminescent sources, electro-luminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, Trine-luminescent sources, thermo-luminescent sources, triboluminescent sources, sonoluminescent sources, radioluminescent sources, and luminescent polymers.

"lighting unit", "lighting fixture", and "luminaire" may be used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

"light guide panel ("LGP")" should be understood to refer to a relatively thin, flat translucent panel, typically having a rectangular shape, and having a precisely patterned surface for transmitting, reflecting and diffusing light from a light source towards the front side of the panel and producing a relatively even distribution of light across the panel.

"lamp" refers to the light source of a lighting unit, lighting fixture or luminaire and may be understood to include for example one or more incandescent or fluorescent bulbs, LEDs, LGPs ("light guide panel"), and/or other types of artificial light sources.

"edge-lit LED light guide panel" refers to a light guide panel illuminated by one or more LEDs mounted around the perimeter of the light guide panel.

"binned LED" refers to one or more LEDs which have been sorted, such as in production by an LED manufacturer, based upon one or more testing criteria or parameters such as for example lumen intensity, color temperature and/or voltage. "Multiple-binned LED" refers to a binned LED that has been sorted based upon more than one testing criterion or parameter.

"high flux LED" refers to an LED having a luminous flux greater than about 1000 lumens from a standard 3 mm sized LED (e.g., having a 3 mm×3 mm area).

"optical grade" with reference herein to LEDs refers to the light transmission and/or refractive index properties of the light transmitting material used in the manufacture of the LED.

"PMMA" as used herein is an acronym for a polymethyl methacrylate transparent polymer plastic material.

Referring now to the drawings in detail, FIG. 1 shows an exemplary use of soft lighting such as would be employed in a typical visual media application such as video, film, or still photography production, visual media display, and computer-generated imagery. FIG. 1 depicts a conventional three point lighting system, although it should be understood that this particular use of visual media soft lighting is shown merely as one example of a use of visual media soft lighting. The three point lighting system of FIG. 1 allows a subject 1 to be illuminated as desired, while also controlling or eliminating shadows produced by the direct lighting.

A key light 2 shines directly upon the subject 1 and serves as the principal illuminating source. Key light 2 is typically placed to one side of the subject 1 so that one side is well lit and the other side has some shadow. A back light 3 illuminates the subject 1 from behind, casting upon the subject 1 a rim or border of light that serves to separate subject 1 from the background and also to highlight the shape and contours of the subject 1.

Visual media soft light is used to cast shadowless light, to reduce shadows, and to make a subject appear more beautiful or youthful by making facial and body wrinkles and blemishes less visible. In FIG. 1, a fill light 4 provides visual media soft light on the subject 1, but from a side angle relative to the key light 2 and a view point or camera 6. The fill light 4 balances the key light 2 by illuminating shaded surfaces, and lessening or eliminating shadowing effects, such as the shadow cast by a person's nose upon the rest of the face. Visual media lighting without the soft lighting of fill light 4 can result in unflatteringly stark contrasts, depending upon the harshness or hardness of the light emanating from key light 2.

Figure 2:
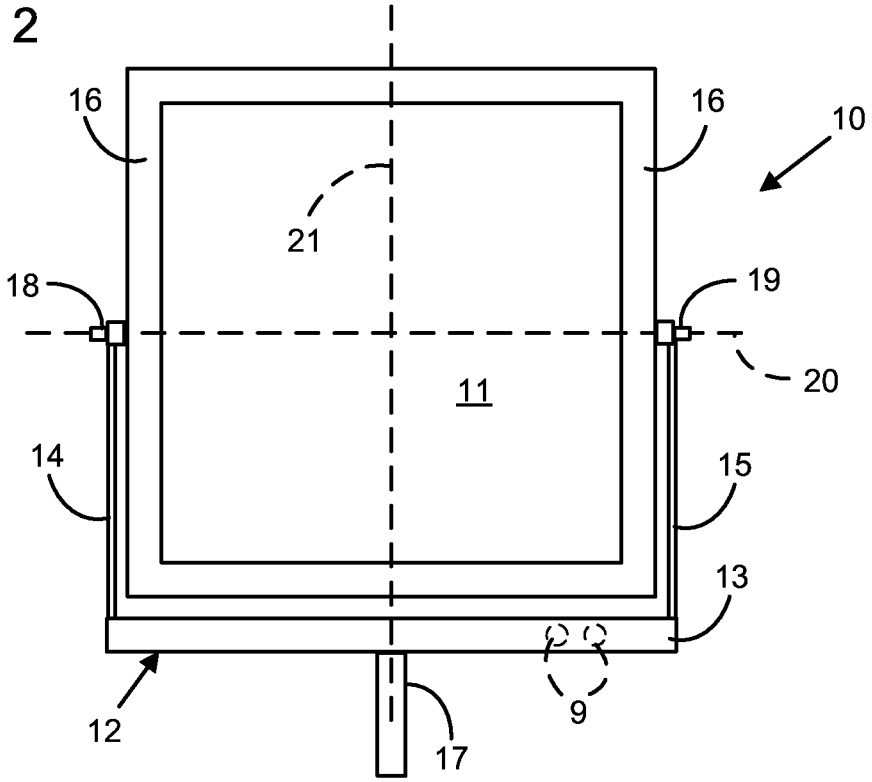
FIGS. 2 and 3 depict respective front and side views of a first exemplary embodiment of a visual media soft lighting luminaire according to the present invention.
Figure 3:
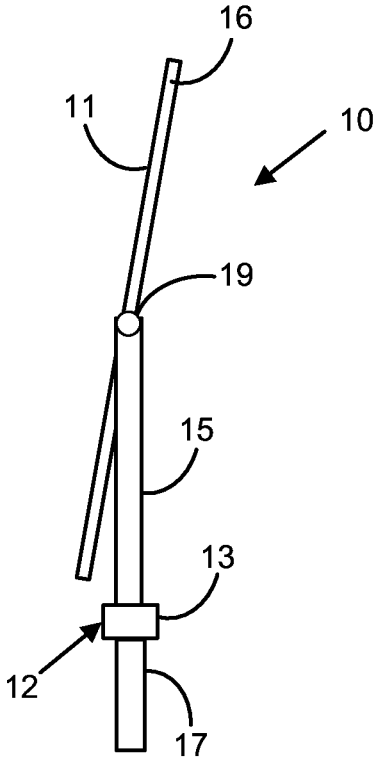

FIGS. 2 and 3 depict a first exemplary embodiment of a visual media soft lighting luminaire 10 such as could be used as the fill light 4 depicted in FIG. 1. In this embodiment, luminaire 10 includes a visual media soft light panel 11 supported on a mounting yoke 12. Mounting yoke 12 includes a cross bar 13 and a pair of transverse mounting arms 14 and 15 extending from the cross bar 13, between which a frame 16 about the periphery of light panel 11 is pivotally mounted. In the illustrated implementation, cross bar 13 is connected to and supported by a support post 17, which may be supported on a floor or the ground by a tripod or other conventional type support mount or stand (not shown), or alternatively supported by attaching post 17 directly to a ceiling, wall, or other suitable support structure. Optionally, light panel 11 may include on its back side a simple bracket (not shown), along frame 16 or located elsewhere, from which light panel 11 can be hung from a hook or other projection on a wall, like a picture.

Frame 16 of light panel 11 is pivotally mounted to mounting arms 14 and 15 at pivots 18 and 19 that allow panel 11 to be tilted or rotated about a pivot axis 20 to direct soft light illumination where desired. For example, when visual media soft lighting luminaire 10 is used in a ceiling- or floor-mounted orientation, pivot axis 20 could have a horizontal orientation (as shown in FIG. 2) and panel 11 could be tilted up and down. If mounted on a wall or other vertical support, pivot axis 20 could have a vertical orientation and panel 11 could be tilted side to side. In addition, cross bar 13 may be pivotably connected to support post 17 so that panel 11 can to be pivoted or swiveled on an axis 21 that is transverse (e.g., perpendicular) to axis 20 to permit both side-to-side (or left and right) tilting and up and down tilting.

In one implementation, cross bar 13 may be configured as a housing for power supply and lighting control circuitry (e.g., on/off power control, dimmer control, AC jumper, transformer, etc., not shown) for operating the panel 11. As one example, a LED power supply for the panel 11 may be a dimmable LED driver Model #LPF-60D-24 manufactured and distributed by Mean Well USA located in Fremont, Calif. Moreover, the LED power supply for the panel 11 may optionally utilize a power inverter that generates AC power for the LED power supply from a DC power source such as batteries if, for example, AC power is not available. In other implementations, a DC LED power supply may be employed to be powered directly by a DC power source, such as batteries.

Housing the power supply and lighting control circuitry in cross bar 13 simplifies the set-up and decreases the footprint of luminaire 10 and facilitates separate replacement of light panel 11 and the power supply and lighting control circuitry. With the power supply and lighting control circuitry in cross bar 13, user controls such as power (on/off) and brightness selection, for example, may be mounted on cross bar 13 as a switch and a variable knob. Alternatively the power supply may be housed in a wire- or cable-connected box that is mountable to and removable from the cross bar 13.

As another implementation option, the shape and dimensions of light panel 11 may be produced in a modular rectangular (e.g., square) size of, for example, 2 feet×2 feet (2'×2'), with a panel thickness not greater than 2 inches, for example, and in a range from about ¼ inch to about ½ inch in some implementations. In an implementation based on metric dimensions, light panel 11 may have lateral dimensions of 600 mm×600 mm. Alternatively, panel 11 could be sized with smaller or larger lateral dimensions based on the specific application.

Figure 4:
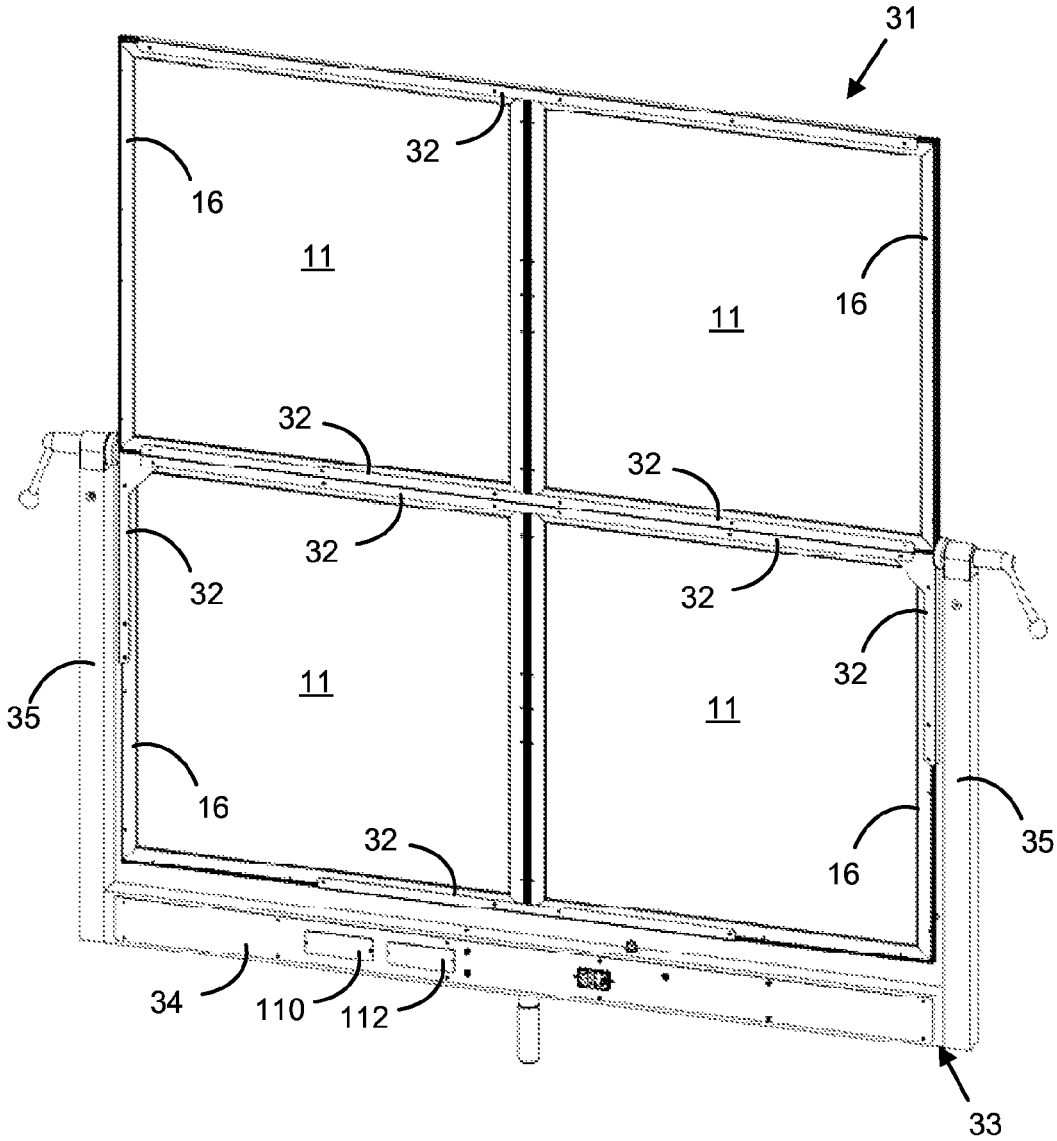
FIG. 4 depicts a visual media soft lighting luminaire of the present invention having four light panels mounted in fixed relation together.

FIG. 4 is an illustration of a multi-panel luminaire 31 for supporting an array of multiple (e.g., 4) light panels 11 that are mounted together in a fixed relation to form a 4'×4' panel that may be used, for example, as a substitute for a conventional 4'×4' shiny board commonly used for redirecting sunlight to provide a soft lighting fill light such as in visual media soft lighting. For example, light panels 11 may be fixed together by brackets 32 that are secured to frames 16 of light panels 11. Luminaire 31 includes a yoke 33 with a cross bar 34 and mounting arms 35 that support the array light panels 11 together. Cross bar 34 is connected to and supported by a support post, which may be supported on a floor or the ground by a tripod or other conventional type support mount or stand (not shown), or alternatively supported by attaching the support post directly to a ceiling, wall, or other suitable support structure, as described with reference to luminaire 10 (FIGS. 2 and 3). The brightness of light panels 11 of luminaire 31 may be controlled separately or together in any user-selected grouping of multiple panels.

Figure 5:
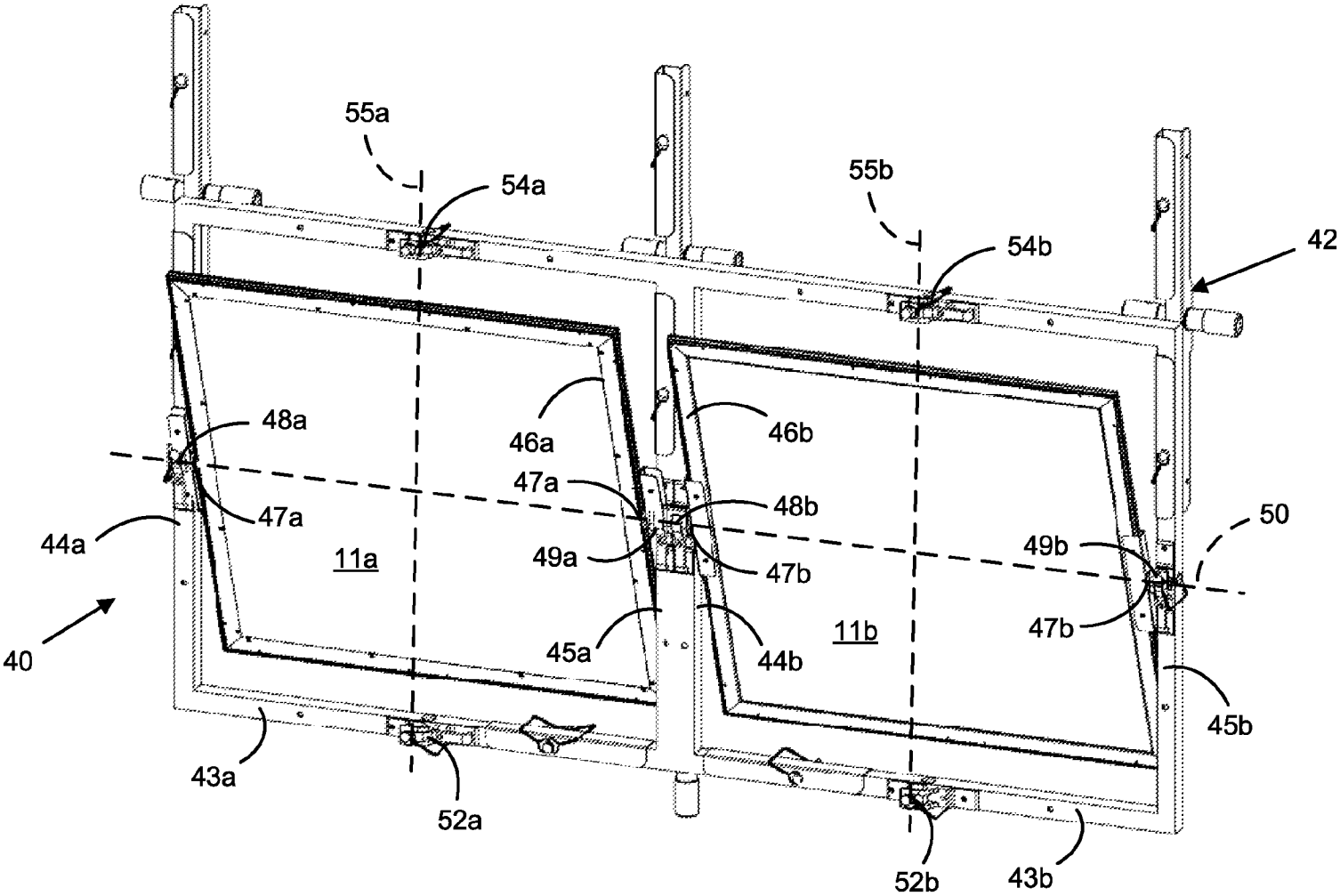
FIG. 5 depicts a visual media soft lighting luminaire of the present invention having four light panels (only two panels shown) mounted together and tiltable individually or together.

As illustrated in FIG. 5, a multi-panel luminaire 40 for supporting multiple (e.g., 4) light panels (only two light panels 11*a* and 11*b* shown) that are mounted together to form a 4'×4'. The following description is directed to light panels 11*a* and 11*b*, but would be similarly applicable to the other two light panels of luminaire 40. Light panels 11*a* and 11*b* may be tiltable separately, as illustrated, or may be in fixed co-planar relation to each other to be tilted or positioned together as a single structure. Likewise, the brightness of light panels 11*a* and 11*b* of luminaire 40 may be controlled separately or together in any user-selected grouping of multiple panels. Luminaire 40 includes a multi-panel mounting frame 42 that may be mounted on a yoke (not shown) and includes for each of panels 11*a* and 11*b* a corresponding cross bar 43*a*, 43*b*, transverse mounting arms 44*a*, 44*b* and 45*a*,45*b*, and a peripheral frame 46*a*, 46*b*, respectively. Adjacent mounting arms positioned next to each other may be integrated together (as illustrated by arms 45*a*, 44*b*), and luminaire 40 may be supported on a floor or the ground by a tripod or other conventional type support mount or stand (not shown), or alternatively supported by attachment directly to a ceiling, wall, or other suitable support structure.

Frames 46*a*, 46*b* each include a respective pair of posts 47*a*, 47*b* (mostly obscured in the illustration) that may be pivotally and releasably mounted to corresponding mounting arms 44*a*, 44*b* and 45*a*, 45*b* at pivot brackets 48*a*, 48*b* and 49*a*, 49*b* that allow panels 11*a*, 11*b* to be tilted or pivoted about horizontal pivot axis 50 to direct soft light illumination where desired. Posts 47*a*, 47*b* on either or both of frames 46*a*, 46*b* may decoupled from pivot brackets 48*a*, 48*b* and 49*a*, 49*b* and coupled to pivot brackets 52*a*,52*b* and 54*a*, 54*b* to allow panels 11*a*, 11*b* to be tilted or pivotted about vertical pivot axes 55*a*, 55*b* to direct soft light illumination where desired. In the illustrated implementation, each of panels 11*a*, 11*b* may be tilted or pivoted about only one of the horizontal or vertical axes or 55*a*, 55*b* at a time. It will be appreciated, however, that in alternative implementations a doubled-gimbaled yoke could allow pivoting of panels 11*a*, 11*b* about both horizontal and vertical axes simultaneously.

Figure 6:
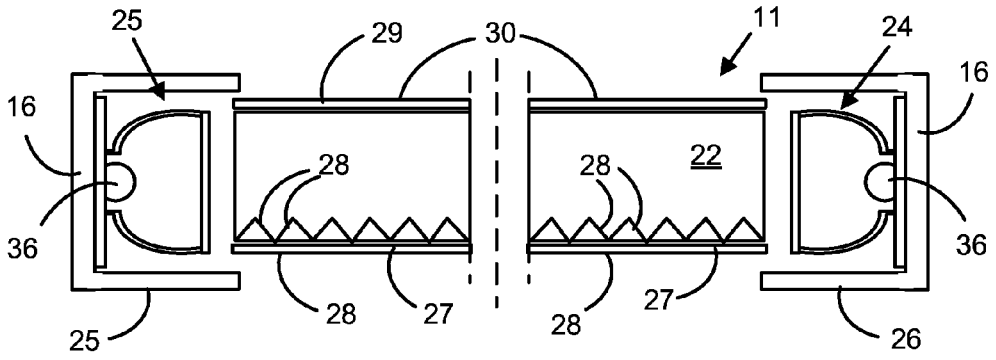
FIGS. 6 and 7 are cross-sectional top and front views of a visual media soft light panel.

FIGS. 6 and 67 are respective top and front cross-sectional views of light panel 11, which includes a planar light guide plate 22 that is illuminated by one or more LED light sources 24 positioned at the periphery of light panel 11. Light guide plate 22 and LED light sources 24 are positioned between a reflective panel 27 extending across a rear face 28 of panel 11 and a translucent diffusion panel 29 positioned across a front face 30. In one implementation, multiple LED light sources are positioned along opposite edges 25 and 26 of panel 11 within frame 16. For example, 72 LED light sources 24 may be positioned along each of edges 25 and 26 in a light panel 11 having planar dimensions of 2 feet by 2 feet, with edges 25 and 26 extending vertically along the lateral sides. It will be appreciated, however, that edges 25 and 26 may alternatively be respective top and bottom edges with light guide plate 11 oriented accordingly. In yet another implementation, the LED light sources 24 may be disposed along only one edge or along all four peripheral edges of the light panel 11 in order to maximize the illumination intensity, with light guide plate configured to receive light from each of the edges, and any number of LED light sources 24 may be positioned at the periphery of light panel 11 according to the lateral dimensions of the light panel, the brightness and lighting characteristics of the LED light sources 24, and the desired brightness of the light panel 11.

Light guide plate 22 may be formed of a transparent material such as, for example, a PMMA acrylic resin, and includes a light guide structure 28 in the form of a pattern of surface indentations or rises that are etched, scratched, printed, laser cast, machined, or otherwise formed to guide, diffuse, and scatter light, as is known in the art. As a result, light guide structure 28 cooperates with reflective panel 27 and diffusion panel 29 to provide a substantially uniform distribution of light emitted from LED light sources 24 across and through front face 30. It will be appreciated that various light guide structures or patterns may be employed for this purpose.

Light guide structure 28 may include a V-cut pattern (FIG. 6), illustrated as a plurality of V-shaped grooves, that is illuminated by LED light sources 24. One implementation of such a V-cut pattern is described in U.S. Pat. No. 7,252,427 of Teng et al., which is hereby incorporated by reference. The light guide plate 22 distributes light emitted from the one or more LED light sources 24 evenly over the light-emitting front face 30 of the light panel 11. Diffusion panel 29 functions to diffuse light emanating from light guide plate 24 to produce a well-diffused, uniform soft light source across front face 30. Thus the light emitted from LED light sources 24 positioned along edges 25 and 26 of panel 11 travels across light guide panel 11 and is directed generally evenly through the diffusion plate 29 and outward from front surface 30. In some implementations, light guide panel 11 may provide sufficient diffusion of light that a luminaire 10 may be formed without diffusion panel 29.

Figure 7:
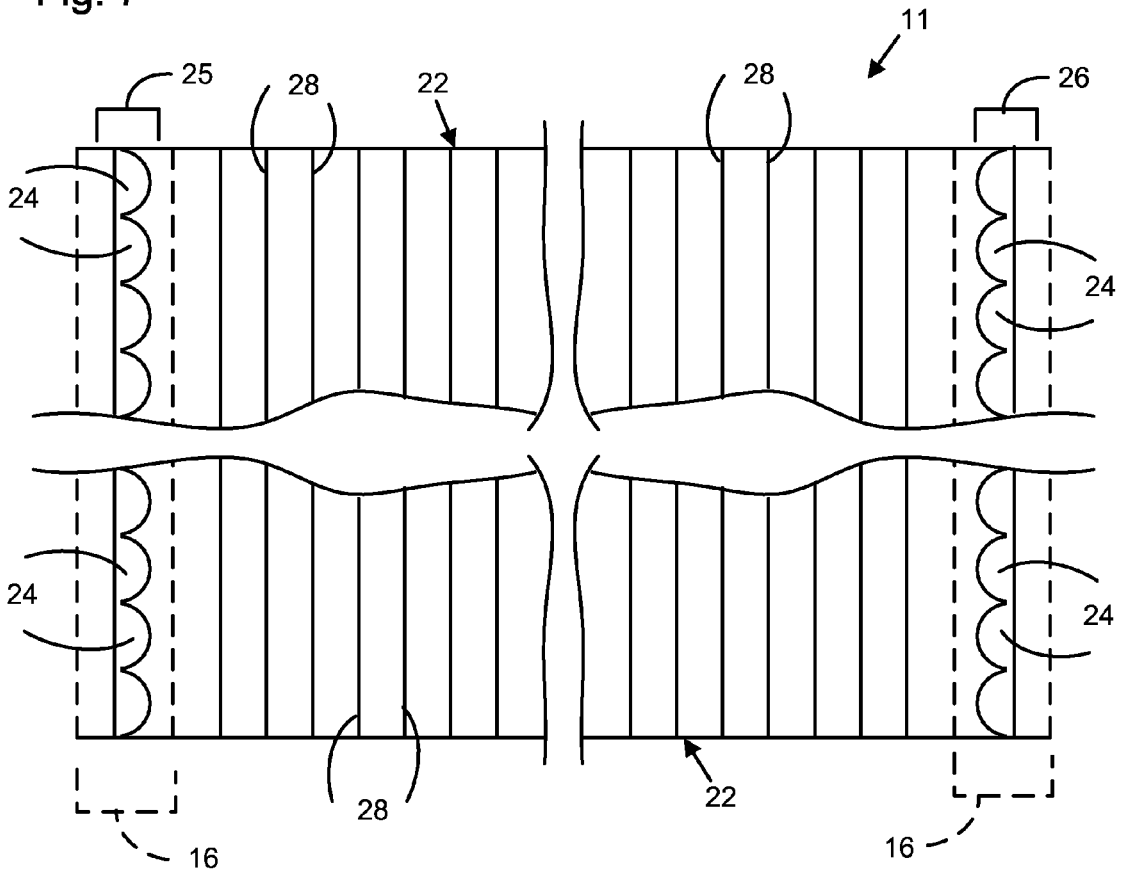
Figure 8:
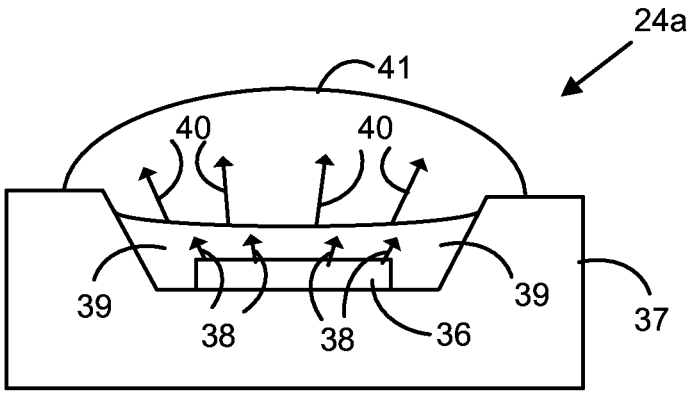
FIGS. 8 and 9 are cross-sectional views of LED light sources with phosphor material used for edge illumination of the visual media soft light panel.

Each LED light source 24 may be or may include one or more LEDs, such as an optical grade, singly- or multiply-binned, high-flux LEDs operated to provide light of a color temperature corresponding to visual media illumination such as, for example, a Kelvin color temperature in a range from about 3000K to about 6000K. FIG. 8 illustrates as one example a LED light source 24*a* that includes an optical grade, binned high-flux LED 36 mounted to a heat sink 37 and operated to direct light 38 into a phosphor material 39, which in response generates light 40 of a selected color temperature, such as for example 3200K (warm yellow light mimicking sunrise/sunset light conditions) or 5500K (cool full spectrum white light mimicking daylight conditions). Light 40 generated by phosphor material 39 passes through a lens 41 to light guide plate 22 (FIGS. 6 and 7). For example, LED 36 may be in contact with or encapsulated by phosphor material 39. LED 36 may be selected to emit light 38 of a color or frequency (e.g., blue light) that cooperatively activates phosphor material 39 to generate light 40 of the selected color temperature.

Figure 9:
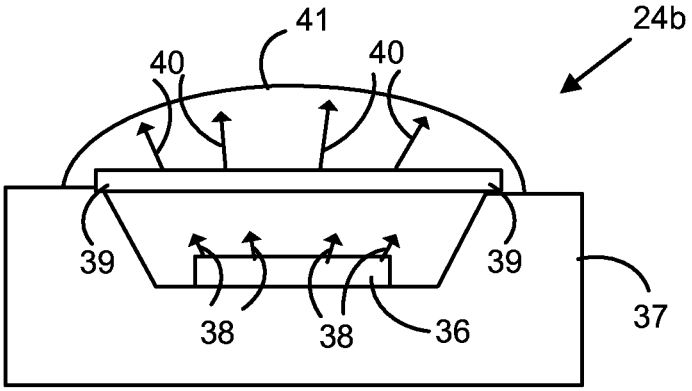

FIG. 9 illustrates as one example a LED light source 24*b* employing a remote phosphor configuration in which the phosphor material 39 is spaced-apart from LED 36 with an air gap therebetween to increase the light-emitting efficiency and operating life of LED 36 by decreasing the operating temperature of the phosphor material 39 and increasing activation of phosphor 39 by light from LED 36. It is believed that phosphor material 39 having no or minimal mercury would generate light with correspondingly no or minimal undesirable green light components. Also, the use of binned LEDs can also help to reduce the generation of undesirable green light components.

LED light sources 24 may have a color rendering index (CRI), which characterizes light generated by light sources 24, of a value of between 70 and 90 at the operating color temperatures. In some implementations, LED light sources may have a CRI of at least about 85 at color temperatures of either 3200K or 5500K for visual media soft lighting applications. Color rendering index (CRI) is a measure of the ability of a light source to reproduce colors of objects faithfully in comparison with a natural light source, with 100 being the maximum. Light emitting diodes (LEDs) with CRI below 70 are not generally suitable for use even for general indoor lighting applications. For professional lighting requirements such as needed for visual media lighting a CRI of 85 or above is desirable.

Moreover, LED light sources 24 may employ one or more "binned" LEDs 36. "Binning" is used in the production of LEDs to characterize and sort them according to selected performance criteria. In some implementations, binned LEDs have been found to be useful in the manufacture of light guide panels 11 for producing high quality soft lighting, specifically with regard to certain performance criteria such as light output and color. The typical methods for manufacturing LEDs 21 can create significant product variations that impact the lumen intensity, color temperature and/or operating voltage of the LEDs. To deal with these issues, LED manufacturers may sort their LED production into bins based upon various testing criteria and parameters such as those previously discussed. The binning process provides the opportunity for a luminaire manufacturer to purchase LEDs that meet specific quality criteria and performance ranges commensurate with the desired lighting performance qualities. Further, it has been found that binning parameters can be combined (i.e., multiply binned) to sort based upon two or more criteria such as for example color temperature and color rendering, so as to permit even more rigorous control parameters to be achieved with LED soft lighting applications than has been hitherto achieved in the arts, media, and entertainment lighting industries.

The operation of each light panel 11 may be controlled by an operator with a controller such as a handheld controller that may communicate with the power and control circuitry of the light panel 11 through directly accessible controls or through wired or wireless communication. The controller may be a dedicated hardware device coupled by wire for controlling one or more light panels 11. For example, a wired coupling may employ twist lock audio cable plugs with a lightweight, all in one, tethered power supply (not shown) for powering the multiple light panels 11. As an alternative, the controller may be a programmable computing device with wired or local wireless communication capabilities such as, for example, a handheld computing device like a tablet computer or a smartphone. For example, the controller may be operational to turn each light panel 11 on or off and vary the brightness of light generated by each panel 11, either separately or together simultaneously, or in some implementations select a desired color temperature of operation.

Figure 10:
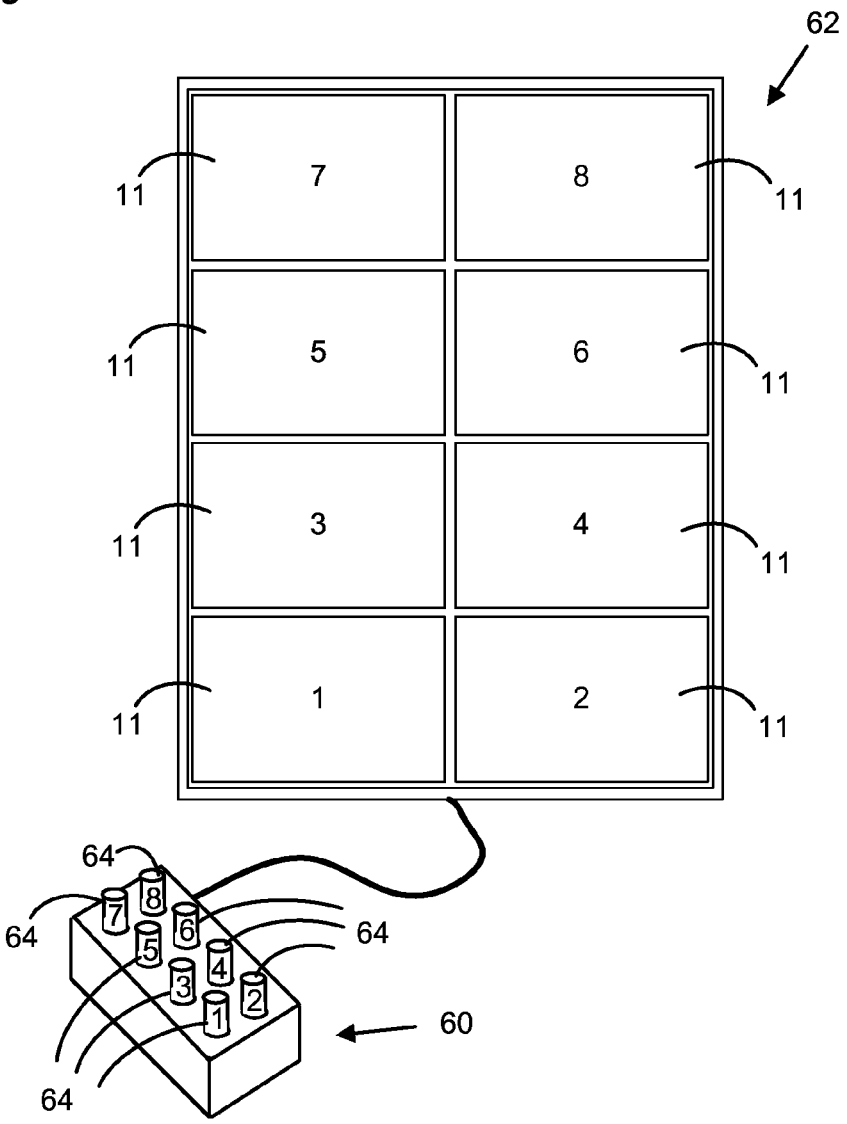
FIG. 10 illustrates a dedicated luminaire controller in wired communication with a visual media soft light luminaire.

FIG. 10 illustrates as an example a dedicated luminaire controller 60 in wired communication with a luminaire 62 having an array of 8 light panels 11. Controller 60 includes a control knob or switch 64 for each light panel 11 to power it on or off and set its brightness. It will be appreciated that controller 60 could be configured to control any number of light panels 11 in any number of luminaires. Moreover, wired communication between a controller 60 and each luminare may employ standardized lighting control couplings and protocols such as, for example, DMX512 ("Digital Multiplex"), currently promulgated by United States Institute for Theatre Technology as USITT DMX512/1990, or DMX512-A currently promulgated as USITT DMX512-A, both relating to asynchronous serial digital data transmission standard for controlling lighting equipment and accessories.

Figure 11:
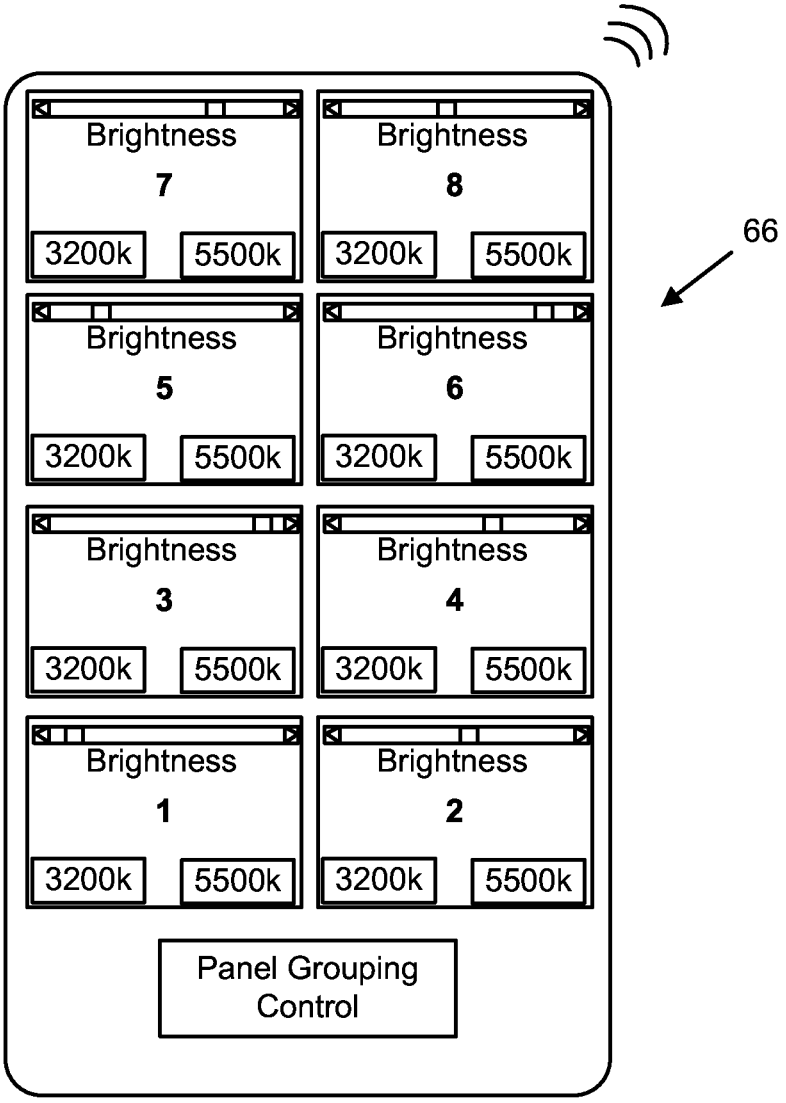
FIG. 11 illustrates a handheld programmable computing device for controlling a visual media soft light luminaire with multiple light panels.

FIG. 11 illustrates as another example a handheld programmable computing device 66 (e.g., a tablet computer or a smartphone) with local wireless communication capabilities running application software for controlling a luminaire with 8 light panels, for example. The local wireless communication may employ any wireless communication format including, for example, Wi-Fi, Bluetooth, infrared, etc. Computing device 66 operates with a touchscreen user interface through which the operator can power on or off each of the light panels and also control the brightness (e.g., dimmer control) of each light panel, separately, in operator-selected subsets, or all together.

Figure 12:
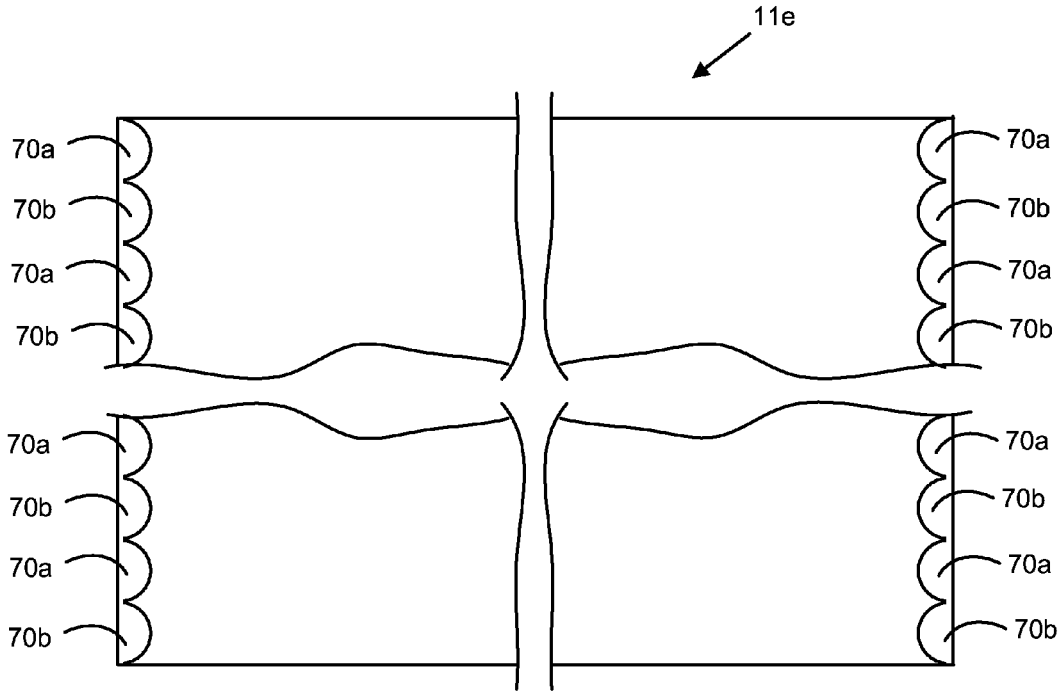
FIG. 12 is a schematic illustration of a light panel with LED light sources to separately generate light of different color temperatures.

In addition, computing device 66 illustrates that a color temperature can be selected for each of the light panels. In some implementations, for example, each light panel may include LED sources to generate light of more than one color temperature such as, for example, separate LED light sources to generate 3200K light (warm yellow light mimicking sunrise/sunset light conditions) or 5500K light (cool full spectrum white light mimicking daylight conditions) according to the color temperature that is selected by the operator. As an example, FIG. 12 is a cross sectional front view of a light panel 11*e* that includes LED light sources 70*a* and 70*b* to separately generate light of 3200K color temperature or 5500K color temperature, as selected by the operator. Alternatively, different combinations of LED light sources could be activated to generate light of other different color temperatures that are selectable by the operator.

Figure 16:
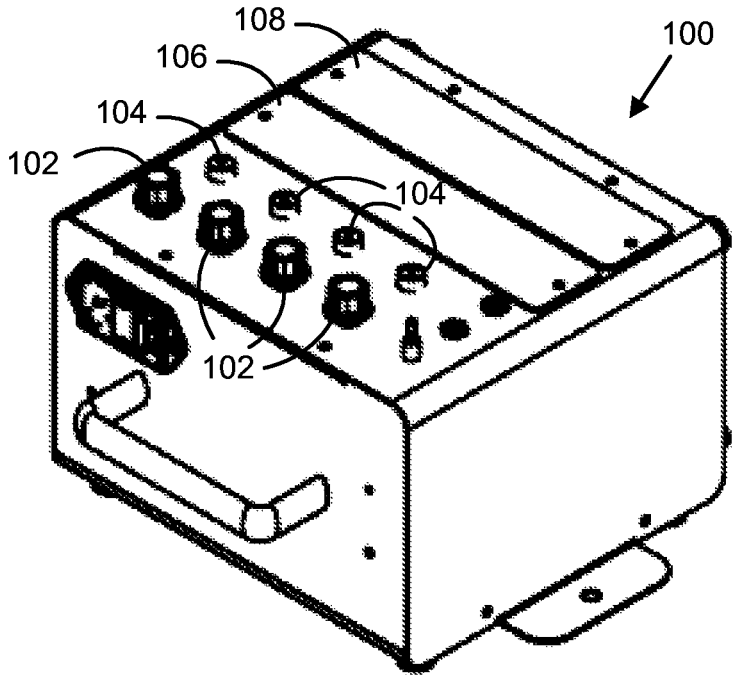
FIG. 16 illustrates a dedicated luminaire controller for controlling light panels of a visual media soft light luminaire.

FIG. 16 is an illustration of another implementation of a dedicated luminaire controller 100 with four controls 102 for controlling brightness of each of four light panels 11. Controller 100 includes four cable jacks 104, each for connecting a power cable (not shown) between controller 100 and a light panel 11. Controller 100 also includes module slots 106 and 108 (shown with slot covers in place) for receiving optional modules for varying the operation of controller 100. For example, module slot 106 could be configured to receive a DMX control module (not shown) or a Wi-Fi control module (not shown) for controlling the brightness of each of the light modules with a DMX control board or a handheld computing device 66 in wireless communication, respectively, rather than controls 102. The DMX control module includes a DMX cable jack for connection to a conventional DMX lighting control board. Module slot 106 could be configured to receive a power inverter module to power controller 100 and the light panels 11 with a DC power source such as one or more batteries.

In one implementation, control of light panels 11 through a DMX control module or a Wi-Fi control module could be carried on cables connected to cable jacks 104. In another implementation, control of light panels 11 through DMX control module or Wi-Fi control module may be carried from controller 100 to the light panels by DMX format cabling or Wi-Fi signals, respectively. Similarly, and with reference to luminaire 31 of FIG. 4, for example, which may include a power supply within cross bar 34, cross bar 34 may include module slots 110 and 112 (shown with slot covers in place) for receiving optional modules for varying the operation of controller 100. For example, module slot 110 could be configured to receive a DMX control module (not shown) or a Wi-Fi control module (not shown) for controlling the brightness of each of the light modules with a DMX control board or a handheld computing device 66 in wireless communication, respectively. Module slot 112 could be configured to receive a power inverter module to power controller 100 and the light panels 11 with a DC power source such as one or more batteries.

Figure 13:
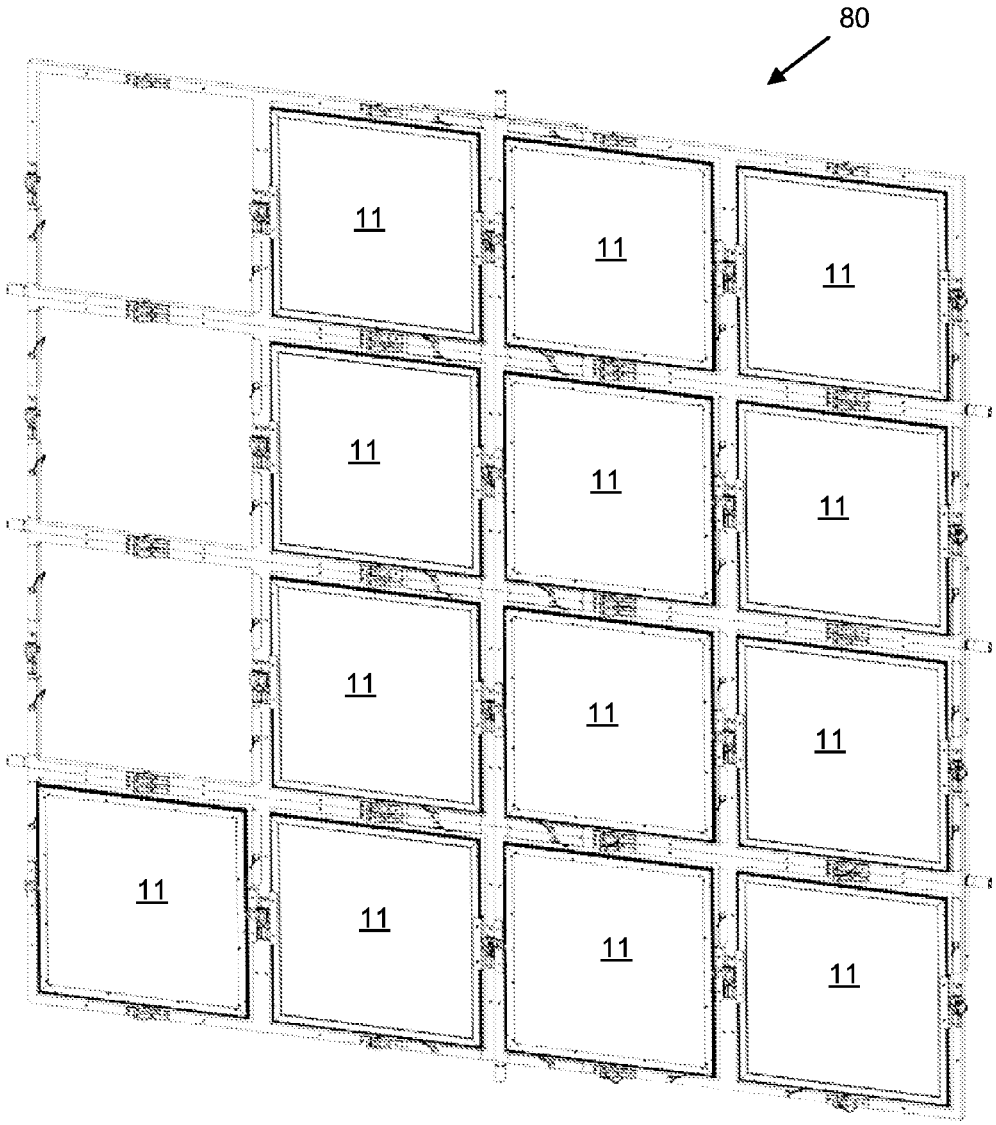
FIGS. 13 and 14 illustrate soft light luminaires configured as modular wall- or ceiling-mounted lighting units.
Figure 14:
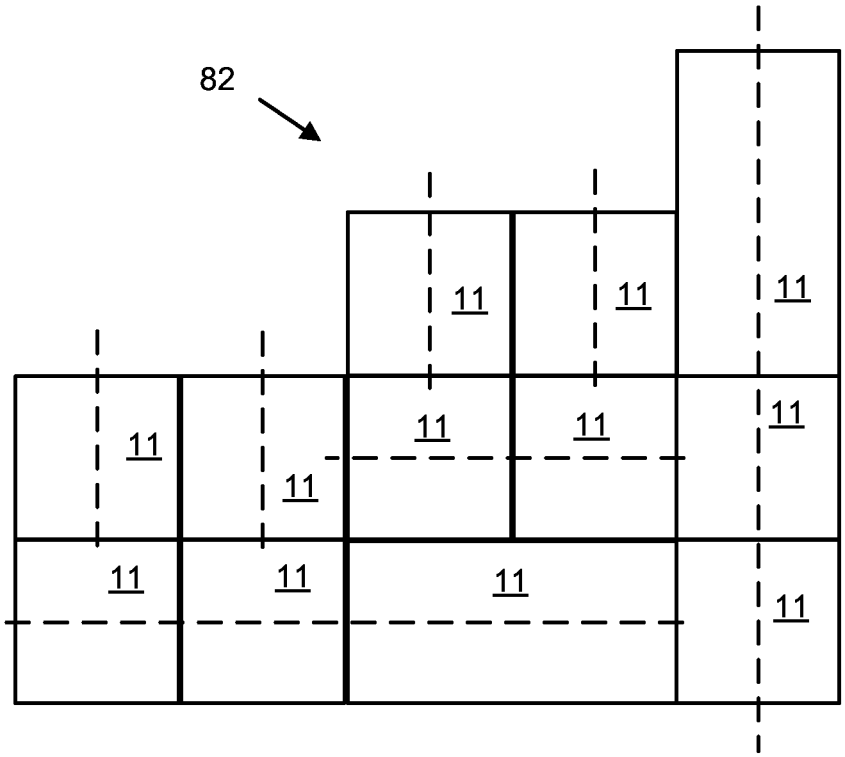

As further embodiments, FIGS. 13 and 14 illustrate soft light luminaires 80 and 82, respectively, in the form of modular wall- or ceiling-mounted lighting units that each includes an array of multiple modular interconnected light guide panels 11. As seen in FIG. 13, hinged mounting brackets analogous to those described with reference to FIG. 5 allow panels 11 to be separately pivoted or tilted horizontally or vertically to independently direct the soft light emanating from each panel to achieve a desired soft lighting. As illustrated in FIG. 14, different panels 11 may be configured to pivot together or individually about different axes, as indicated by dashed lines.

Light panels 11 of luminaires 80 and 82 may be arranged in any desired array of one or more vertical and horizontal rows. A modular type frame having multiple interconnected frame modules may also provided, each frame module serving to mount a light panel 11 for either horizontal or vertical tilting depending upon which pair of mounting brackets is selected for attachment. Any desired number of light panels 11 can be assembled in any pattern or arrangement, mixing horizontal and vertical tilting light panels 11 in many different layouts. Luminaires 80 an 82 can be mounted in a vertical orientation, such as along a wall, or in a horizontal orientation such as suspended from a ceiling, or otherwise oriented as desired. The relatively thin, flat light panels 11 provide a smaller footprint, increased access, and easier setup.

Figure 15:
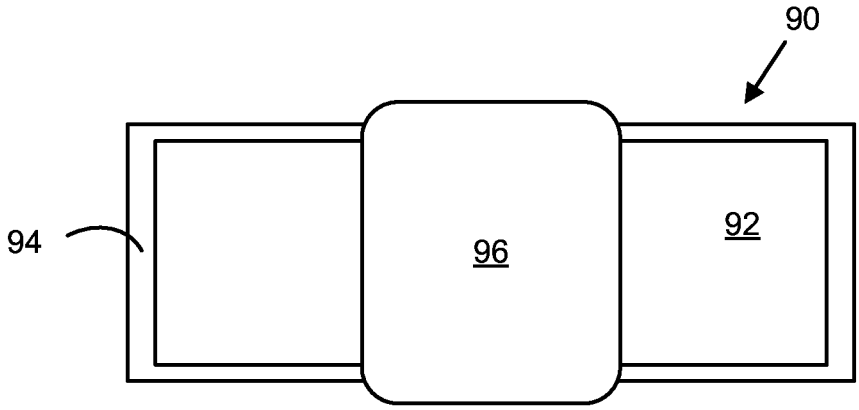
FIG. 15 illustrates a mini or handheld size visual media soft light luminaire.

FIG. 15 illustrates a mini or handheld size visual media soft light luminaire 90 designed for use in tight or otherwise space-restricted locations (e.g., interior car scenes) having dimensions of, for example, 6 inches by 12 inches. The luminaire 90 includes an LED edge-lit light panel 92 with a peripheral frame 94 and one or more LED light sources (not shown) arranged along only one side of panel 92 or in one corner, as illustrated in U.S. Pat. No. 7,252,427 of Teng et al. Luminaire 90 may include a wired coupling to a separate battery or other power supply, or may include a battery within frame 94 to power operation. Optionally, luminaire may be held in place with an elastomeric sleeve 96 capable of securing luminaire 90 to an available structure, such as a car windshield visor or other structure. On/off power, brightness, and optionally color temperature may be controlled by an operator with the controls mounted to frame 94 (not shown) or a controller in wired or wireless communication with luminaire 90.

It will be appreciated that luminaires 80 and 82, or individual light panels 11, could optionally be used to provide interior or exterior illumination in residential, commercial, or other lighting situations. As with operating LED light sources with color temperatures adapted to visual media soft lighting standards, the LED light sources used for such light sources could be operated to provide desired color temperature light such as, for example, 4100K as is used in some interior lighting applications. With the generally less-demanding color temperature requirements of such general lighting applications, desirable color temperature lighting can be achieved with less regard to color rendering index or with simple combinations of mixed red, green and blue LEDS. However, color temperature selection can be used to obtain light of a desired color temperature adapted for a particular architectural setting, situation, or coloring. Such LED edge-lit general illumination light panels could provide diffusedwhite light illumination that may be suited to particular applications, such as warm white lighting used in residences or cool white lighting used in office or other commercial or industrial settings or other white light tones according to particular architectural applications.

Since one of the purposes of soft light (or fill light) is to make the light appear that it is coming from all directions, the designs of the luminaires 80 and 82 are particularly advantageous in that they can direct light in many directions, thus giving the subject or object natural looking coverage or providing illumination of a room in a residential or commercial setting. It is also to be noted that this may be accomplished without the use of any added conventional diffusion materials.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A visual media light panel assembly, comprising:

first and second visual media light panels, each including a substantially planar light guide plate positioned between a reflective panel and a translucent diffusion panel and having at least one peripheral edge, one or more LED light sources positioned to direct emitted light to the at least one peripheral edge of the planar light guide plate and having a visual media lighting Kelvin color temperature, the planar light guide plate being oriented with the reflective panel to transmit through the translucent diffusion panel diffused soft visual media light, and a panel frame engaging peripheral edges of the planar light guide plate, reflective panel, and translucent diffusion panel; and a multi-panel mounting frame supporting the first and second visual media light panels in co-planar relation to each other.

2. The visual media light panel assembly of claim 1 in which the diffused soft visual media light of at least one of the first and second visual media light panels has a color temperature of about 3200K.

3. The visual media light panel assembly of claim 1 in which the diffused soft visual media light of at least one of the first and second visual media light panels has a color temperature of about 5500K.

4. The visual media light panel assembly of claim 1 in which each of the one or more LED light sources includes an LED positioned to direct light to a phosphor material, wherein the phosphor material is responsive to light from the LED to generate light of the visual media lighting Kelvin color temperature.

5. The visual media light panel assembly of claim 4 in which the phosphor material of each LED light source is positioned in a spaced-apart relation to the LED.

6. The visual media light panel assembly of claim 1 in which the light guide plate of each of the first and second visual media light panels includes first and second opposed peripheral edges and one or more LED light sources are positioned to direct emitted light to each of the first and second opposed peripheral edges of each of the first and second visual media light panels.

7. The visual media light panel assembly of claim 1 further comprising a supporting yoke having a cross bar and a pair of support arms, each support arm having with a pivotable coupling to the multi-panel mounting frame.

8. The visual media light panel assembly of claim 7 further including control circuitry for controlling operation of the first and second visual media light panels, and wherein the control circuitry is housed within the cross bar of the supporting yoke.

9. The visual media light panel assembly of claim 1 further including in each of the first and second visual media light panels first and second LED light sources that generate light with color temperatures of about 3200K and 5500K, respectively, and the visual media light panel assembly further including control circuitry for controlling operation of the first and second visual media light panels, including selectively activating the first or second light sources to provide diffused soft visual media light that has a color temperature of about 3200K or about 5500K.

10. The visual media light panel assembly of claim 1 further including control circuitry for controlling operation of the first and second visual media light panels and a remote user-operated controller in communication with the control circuitry.

11. The visual media light panel assembly of claim 10 in which the remote user-operated controller includes a handheld computing device operating an application for controlling the first and second visual media light panels and wherein the handheld computing device is in wireless communication with the control circuitry.

12. The visual media light panel assembly of claim 1 wherein the multi-panel mounting frame includes first and second pairs of pivot brackets coupled to the panel frames of the first and second visual media light panels, respectively, so that the first and second visual media light panels are separately tiltable.

13. The visual media light panel assembly of claim 12 wherein the multi-panel mounting frame in which the first and second pairs of pivot brackets are positioned so that the respective first and second visual media light panels are separately tiltable about parallel first and second axes.

14. The visual media light panel assembly of claim 13 wherein the multi-panel mounting frame further includes third and fourth pairs of pivot brackets coupled to the panel frames of the first and second visual media light panels so that the first and second visual media light panels are separately tiltable about parallel third and fourth axes that are perpendicular to the first and second axes, respectively.

15. A visual media light panel assembly, comprising:

first and second visual media light panels, each including a planar light guide plate positioned between a reflective panel and a translucent diffusion panel and having at least one peripheral edge, and first and second high flux LED light sources that generate light with color temperatures of about 3200K and 5500K, respectively, and are positioned to direct high flux light to the peripheral edge of the planar light guide plate, the first and second LED light sources including LEDs positioned to direct light to first and second phosphor materials, that are responsive to light from the LEDs to generate light with color temperatures of about 3200K and 5500K, respectively, the planar light guide plate being oriented with the reflective panel to transmit through the translucent diffusion panel diffused soft visual media light;

a multi-panel mounting frame supporting the first and second visual media light panels in co-planar relation to each other; and control circuitry for controlling operation of the first and second visual media light panels, including selectively activating the first or second LED light sources.

16. The visual media light panel of claim 15 in which the phosphor material of each LED light source is positioned in a spaced-apart relation to the LED.

17. The visual media light panel assembly of claim 15 wherein the control circuitry is mounted within the multi-panel mounting frame.

18. The visual media light panel assembly of claim 15 wherein the multi-panel mounting frame includes first and second pairs of pivot brackets coupled to the panel frames of the first and second visual media light panels, respectively, so that the first and second visual media light panels are separately tiltable.

19. The visual media light panel assembly of claim 18 wherein the multi-panel mounting frame in which the first and second pairs of pivot brackets are positioned so that the respective first and second visual media light panels are separately tiltable about parallel first and second axes.

20. The visual media light panel assembly of claim 19 wherein the multi-panel mounting frame further includes third and fourth pairs of pivot brackets coupled to the panel frames of the first and second visual media light panels so that the first and second visual media light panels are separately tiltable about parallel third and fourth axes that are perpendicular to the first and second axes, respectively.

* * * * *